US006362705B1

(12) United States Patent
Kuroda et al.

(10) Patent No.: US 6,362,705 B1
(45) Date of Patent: Mar. 26, 2002

(54) DIELECTRIC FILTER UNIT, DUPLEXER, AND COMMUNICATION APPARATUS

(75) Inventors: Katsuhito Kuroda, Matsuto; Jinsei Ishihara, Kanazawa; Hideyuki Kato, Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/407,497

(22) Filed: Sep. 28, 1999

(30) Foreign Application Priority Data

Sep. 28, 1998 (JP) ..... 10-273507

(51) Int. Cl.[7] ..... H01P 1/20; H01P 5/12
(52) U.S. Cl. ..... 333/206; 333/202; 333/134
(58) Field of Search ..... 333/202, 206, 333/134

(56) References Cited

U.S. PATENT DOCUMENTS

| | | | | |
|---|---|---|---|---|
| 4,431,977 A | | 2/1984 | Sokola et al. | 333/206 |
| 4,799,033 A | | 1/1989 | Igarshi et al. | 333/134 |
| 5,633,617 A | | 3/1995 | Tsujiguchi et al. | 333/206 |
| 5,428,325 A | * | 6/1995 | Jachowski et al. | 333/203 |
| 5,712,648 A | * | 1/1998 | Tsujiguchi | 333/134 |
| 5,789,998 A | | 8/1998 | Kim et al. | 333/134 |
| 5,945,896 A | * | 12/1999 | Miyamoto | 333/206 |
| 6,002,309 A | * | 12/1999 | Nishijima et al. | 333/206 |

FOREIGN PATENT DOCUMENTS

EP 0863566 9/1999

OTHER PUBLICATIONS

Patent Abstract of Japan, vol. 1998, No. 13, Nov. 30, 1998 & JP 10 224111 A (Murata MFG CO LTD), Aug. 21, 1998, abstract, figures 2, 4.

Patent Abstract of Japan, vol. 017, No. 676 (E–1475), Dec. 13, 1993 & JP 05 226909 A., (Sony Chem Corp), Sep. 3, 1993, abstract.

Patent Abstract of Japan, vol. 1995, No. 06, Jul. 31, 1995 & JP 07 086807 A (Sony Chem Corp), Mar. 31, 1995, abstract, figures 7A, B.

Patent Abstract of Japan, vol. 017, No. 328 (E–1385), Jun. 22, 1993 & JP 05 037203 A (Alps Electric Co Ltd), Feb. 12, 1993, abstract, figure 7.

Patent Abstract of Japan, vol. 1999, No. 07, Mar. 31, 1999, & JP 05 275904 A (Motorola Inc), Oct. 22, 1993, abstract, figure 5.

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

There provided a dielectric filter unit comprising: a dielectric block having a pair of opposing end surfaces; a plurality of resonator holes respectively passing through the pair of opposing end surfaces of the dielectric block and having a large-sectional area portion and a small-sectional area portion connected to the large-sectional area portion; an inner conductor disposed on the inner surface of each of the resonator holes; an outer conductor disposed on the outer surface of the dielectric block; at least one of the resonator holes constituting a first filter; at least one of the remaining resonator holes constituting a second filter; and the area ratio of the large-sectional area portion to the diameter of the small-sectional area portion of the resonator hole of the first filter being different from the area ratio of the large-sectional area portion to the diameter of the small-sectional area portion of the resonator hole of the second filter.

In the above dielectric filter, the center frequency of each filter can be adjusted without altering the length in the axial direction of resonator holes, of the dielectric block of each filter.

15 Claims, 9 Drawing Sheets

DIELECTRIC FILTER UNIT, DUPLEXER, AND COMMUNICATION APPARATUS

BACKGROUND OF THE INVENTION

1. Field of the Invention

The present invention relates to a dielectric filter unit, a duplexer, and a communication apparatus, used in microwave frequency bands, for example.

2. Description of the Related Art

As a dielectric duplexer to be used in portable telephones, and so on, duplexers in which resonator holes constituting a plurality of dielectric resonators are arranged in a dielectric block have been known. FIG. 9 shows an example of a prior art dielectric duplexer. In the dielectric duplexer 1, resonator holes 3*a*, 3*b*, and 3*c* constituting a transmission filter 7 and resonator holes 3*d*, 3*e*, and 3*f* constituting a reception filter 8 are given in a dielectric block 2 in the form of a rectangular solid.

The resonator holes 3*a* through 3*f* are identical in shape to each other and are of a stepped hole having a large-sectional area portion 4*a* and a small-sectional area portion 4*b* linked to the large-sectional area portion 4*a*. On the inner surface of the resonator holes 3*a* through 3*f* an inner conductor 5 is formed, respectively. In each of the inner conductors 5, a nonconductive portion indicated by g is disposed in the vicinity of the end portion on the side of the large-sectional area portion 4*a* is provided, and this portion is made open-ended. On the outer surface of the dielectric block 2 an antenna terminal ANT, a transmission terminal Tx, and a reception terminal Rx are provided, and at the same time an outer conductor 6 is formed on nearly all the surface except these terminals ANT, Tx, and Rx. Each of the inner conductors 5 is connected to the outer conductor 6 at the end portion on the side of the small-sectional area portion 4*b*, and this portion is made short-circuited.

Then, in the prior art dielectric duplexer 1, because all the resonator holes 3*a* through 3*f* were the same in shape, the area ratio of the large-sectional area portion 4*a* to the diameter of the small-sectional area portion 4*b* of the resonator holes 3*a* through 3*c* constituting the transmission filter 7 (hereinafter, referred to as step ratio) was the same as the step ratio of the resonator holes 3*d* through 3*f* constituting the reception filter 8. Consequently, the adjustment of the center frequency of the transmission filter 7 or reception filter 8 has been carried out by moving the location of the nonconductive portion g of the inner conductor 5 or by altering the length in the axial direction of the resonator holes 3*a* through 3*f* of the dielectric block 2.

For example, when the center frequency of the transmission filter 7 is 1950 MHz and the center frequency of the reception filter 8 is 2140 MHz, if the dielectric constant $\epsilon_r$ of the dielectric block 2 is 21.4, the length in the axial direction of the resonator holes 3*a* through 3*c* of the transmission filter 7 becomes longer than the length in the axial direction of the resonator holes 3*d* through 3*f* of the reception filter 8 to result in the difference of 0.7 mm. Because of this, when the transmission filter 7 and reception filter 8 had been made separately and then both of them were joined and connected to produce the dielectric duplexer 1, because the length of the dielectric block of the transmission filter 7 and length of the dielectric block of the reception filter 8 in the axial direction of the resonator holes are different, a play and a positional discrepancy were likely to occur when they are joined and connected.

SUMMARY OF THE INVENTION

To overcome the above problems, preferred embodiments of the present invention provide a dielectric filter unit, a duplexer, and a communication apparatus in which the adjustment of the center frequency of each of the filters can be made without moving the location of the nonconductive portion of the inner conductor or without altering the length of the dielectric block in the axial direction of the resonator holes.

One preferred embodiment of the present invention provides a dielectric filter unit comprising: a dielectric block having a pair of opposing end surfaces; a plurality of resonator holes respectively passing through the pair of opposing end surfaces of the dielectric block and having a large-sectional area portion and a small-sectional area portion connected to the large-sectional area portion; an inner conductor disposed on the inner surface of each of the resonator holes; an outer conductor disposed on the outer surface of the dielectric block; at least one of the resonator holes constituting a first filter; at least one of the remaining resonator holes constituting a second filter; and the area ratio of the large-sectional area portion to the diameter of the small-sectional area portion of the resonator hole of the first filter being different from the area ratio of the large-sectional area portion to the diameter of the small-sectional area portion of the resonator hole of the second filter.

In the above described dielectric filter unit, at least one of the large-sectional area portions or at least one of the small-sectional area portions of the resonator holes may be a circular shape, a triangle shape, a square shape, a polygon shape, and so on.

In the above described dielectric filter unit, the inner conductor may have a nonconductive portion in the vicinity of one open end portion of the resonator hole.

In the above described dielectric filter unit, the outer conductor may be extended to the pair of end surfaces of the dielectric block where the resonator holes passing through; the outer conductor disposed on one of the pair of end surfaces is electrically separated into an internal portion and a surrounding portion by a strip-like nonconductive portion surrounding each resonator hole; the internal portion includes each resonator hole; and the surrounding portion surrounds the internal portion.

In the above described dielectric filter unit, the dielectric block may be divided into each of the resonator holes.

In the above described dielectric filter unit, the first filter may comprise a dielectric block which is divided into each of the resonator holes; and the second filer comprises a single dielectric block.

Another preferred embodiment of the present invention provides a duplexer comprising the dielectric filter unit.

Yet another preferred embodiment of the present invention provides a communication apparatus comprising either one of the above described dielectric filter or the above described duplexer.

According to the above described structure and arrangement, the center frequency of each filter is adjusted by altering the ratio (step ratio) of the diameter of the large-sectional area portion to the diameter of the small-sectional area portion of each of the resonator holes. That is, when the step ratio is increased, the step portion formed between the large-sectional area portion and small-sectional area portion is heightened. Accordingly, as the conductor path of the inner conductor runs along the surface of the step portion, the path is lengthened that much and the center frequency of the filter is increased. On the contrary, when the step ratio is reduced, the center frequency of the filter decreases. Therefore, without moving the location of the nonconductive portion of the inner conductor or without altering the length of the dielectric block of each filter in the axial direction of the resonator holes the center frequency of the filter is adjusted.

And as a duplexer and communication apparatus according to the present invention are made up of dielectric filter units having the above characteristics and accordingly the length of the dielectric block of each filter in the axial direction of the dielectric holes can be made uniform, the processing for assembly of the duplexer and communication apparatus becomes easy.

Other features and advantages of the present invention will become apparent from the following description of the invention which refers to the accompanying drawings.

DESCRIPTION OF THE PREFERRED EMBODIMENTS

Figure 1:
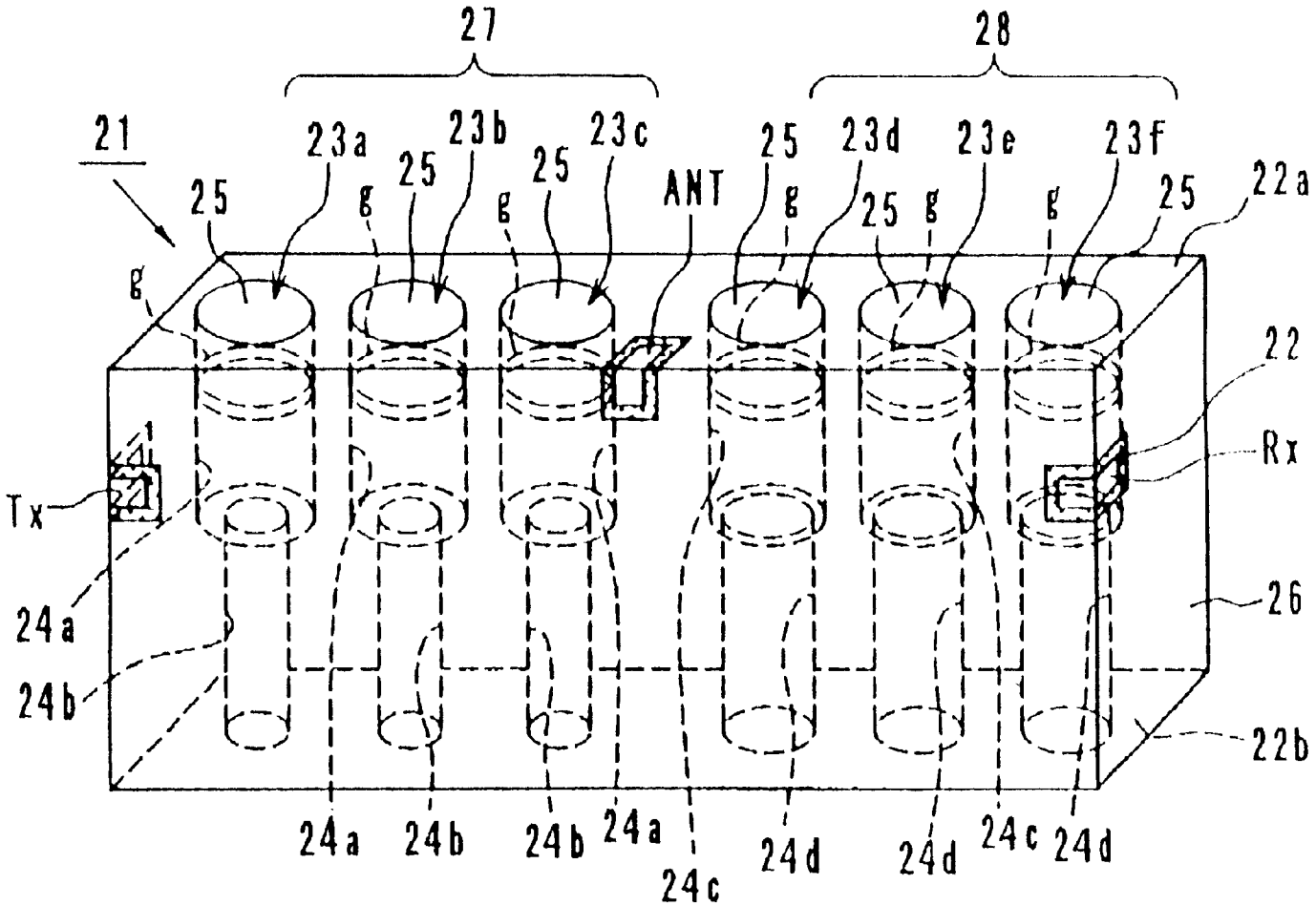
FIG. 1 is a perspective view showing a first preferred embodiment of a duplexer according to the present invention.

First Preferred Embodiment, FIG. 1

One preferred embodiment of a duplexer according to the present invention is shown in FIG. 1. The duplexer 21 comprises a single dielectric block 22 in the form of a rectangular solid. The dielectric block 22 has resonator holes 23*a* through 23*f* passing from one of opposing end surfaces 22*a* and 22*b* completely through to the other. These resonator holes 23*a* through 23*f* are provided in the dielectric block 22 so that their axes run in parallel with each other.

The resonator holes 23*a* through 23*c* constituting a transmission filter 27 are identical in shape to each other and are of a stepped hole having a large-sectional area portion 24*a* and a small-sectional area portion 24*b* linked to the large-sectional area portion 24*a*. The resonator holes 23*d* through 23*f* constituting a reception filter 28 are identical in shape to each other and are of a stepped hole having a large-sectional area portion 24*c* and a small-sectional area portion 24*d* linked to the large-sectional area portion 24*c*. On the inner surface of the resonator holes 23*a* through 23*f* an inner conductor 25 is disposed, respectively. And the step ratio of the resonator holes 23*a* through 23*c* of the transmission filter 27 and the step ratio of the resonator holes 23*d* through 23*f* of the transmission filter 28 are independently established.

On the outer surface of the dielectric block 22, an outer conductor 26 is disposed on substantially all the surface except a transmission terminal Tx, a reception terminal Rx, and an antenna terminal ANT. In the inner conductor 25 of the resonator holes 23*a* through 23*f*a nonconductive portion indicated by g is provided in the vicinity of the end portion on the side of the large-sectional area portions 24*a* and 24*c*, and this portion (that is, portion electrically separated from the outer conductor 26) is made open-ended. On the other hand, the portion of the inner conductor 25 (that is, portion electrically connected to the outer conductor 26) opposite to the open end is made short-circuited.

The resonator hole 23*a* constitutes one dielectric resonator together with the inner conductor 25 disposed on the inner surface of the resonator hole, the dielectric block 22, and the outer conductor 26. In like manner, the resonator holes 23*b* through 23*f* constitute dielectric resonators, respectively. Therefore, the filters 27 and 28 become three-stage bandpass filters, respectively.

The transmission terminal Tx, reception terminal Rx, and antenna terminal ANT having a fixed spacing to the outer conductor 26 are disposed so as to be not condcutive to the outer conductor 26. Between the transmission terminal Tx and the inner conductor 25 of the resonator hole 23*a*, between the reception terminal Rx and the inner conductor 25 of the resonator hole 23*f*, and between the antenna terminal ANT and the inner conductor 25 of the resonator holes 23*c* and 23*d*, an external coupling capacitance Ce is formed respectively. And between the antenna terminal ANT and transmission terminal Tx the transmission filter 27 is arranged, and between the antenna terminal ANT and reception terminal Rx the reception filter 28 is arranged.

In the above structure and arrangement, for example, when the center frequency of the transmission filter 27 is lower than the center frequency of the reception filter 28, the step ratio of the resonator holes 23*a* through 23*c* is made larger than the step ratio of the resonator holes 23*d* through 23*f* by increasing the step ratio of the resonator holes 23*a* through 23*c* of the transmission filter 27 or by reducing the step ratio of the resonator holes 23*d* through 23*f* of the reception filter 28. For example, if the step ratio of the resonator holes 23*a* through 23*c* is increased, the step portion provided between the large-sectional area portion 24*a* and the small-sectional area portion 24*b* is heightened. Accordingly, because the conductor path of the inner conductor 25 runs along the surface of the step portion and is lengthened that much, the center frequency of the transmission filter 27 is increased even if the length of the dielectric block 22 of the transmission filter 27 in the axial direction of the resonator holes 23*a* through 23*c* is not lengthened.

In the duplexer 21 shown in FIG. 1, the large-sectional area portion 24*a* of the resonator holes 23*a* through 23*c* and the large-sectional area portion 24*c* of the resonator holes 23*d* through 23*f* are set to be equal in diameter, and the small-sectional area portion 24*b* of the resonator holes 23*a* through 23*c* is set to be smaller in diameter than the small-sectional area portion 24*d* of the resonator holes 23*d* through 23*f*. Because of this, the location of the nonconductive portion g of the inner conductor 25 can be made uniform regarding all of the resonator holes 23*a* through 23*f*. And the length of the dielectric block 22 (that is, resonator length) in the axial direction of the resonator holes 23*a* through 23*f*, of each of the filters 27 and 28 can be made equal. As the result, the duplexer which is easy to process and assemble can be obtained.

More, when the center frequency of the transmission filter 27 is higher than the center frequency of the reception filter 28, the step ratio of the resonator holes 23*a* through 23*c* of the transmission filter 27 is made smaller than the step ratio of the resonator holes 23*d* through 23*f* of the reception filter 28 by reducing the step ratio of the resonator holes 23*a* through 23*c* of the transmission filter 27, and so on.

Figure 2:
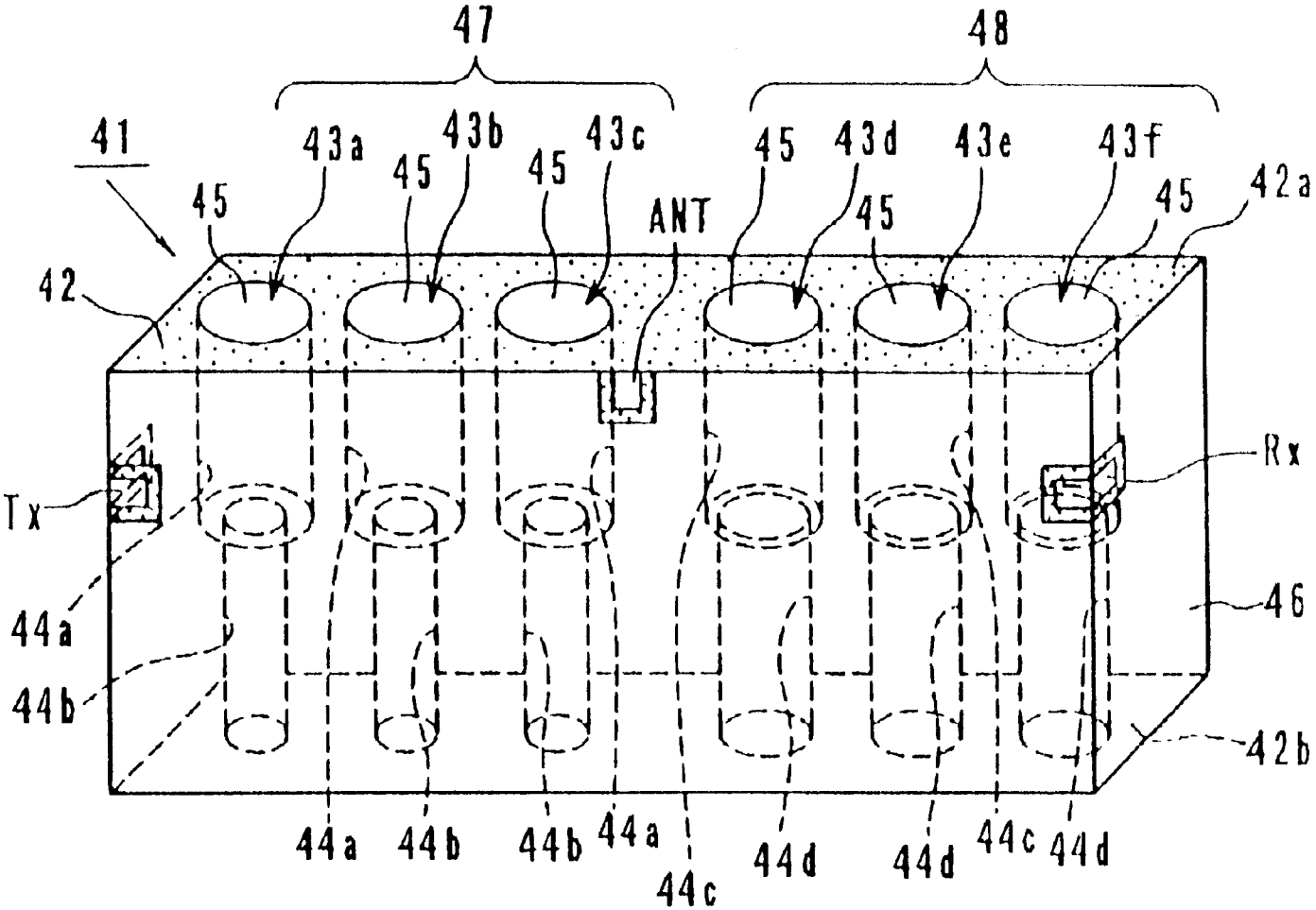
FIG. 2 is a perspective view showing a second preferred embodiment of a duplexer according to the present invention.
Figure 3:
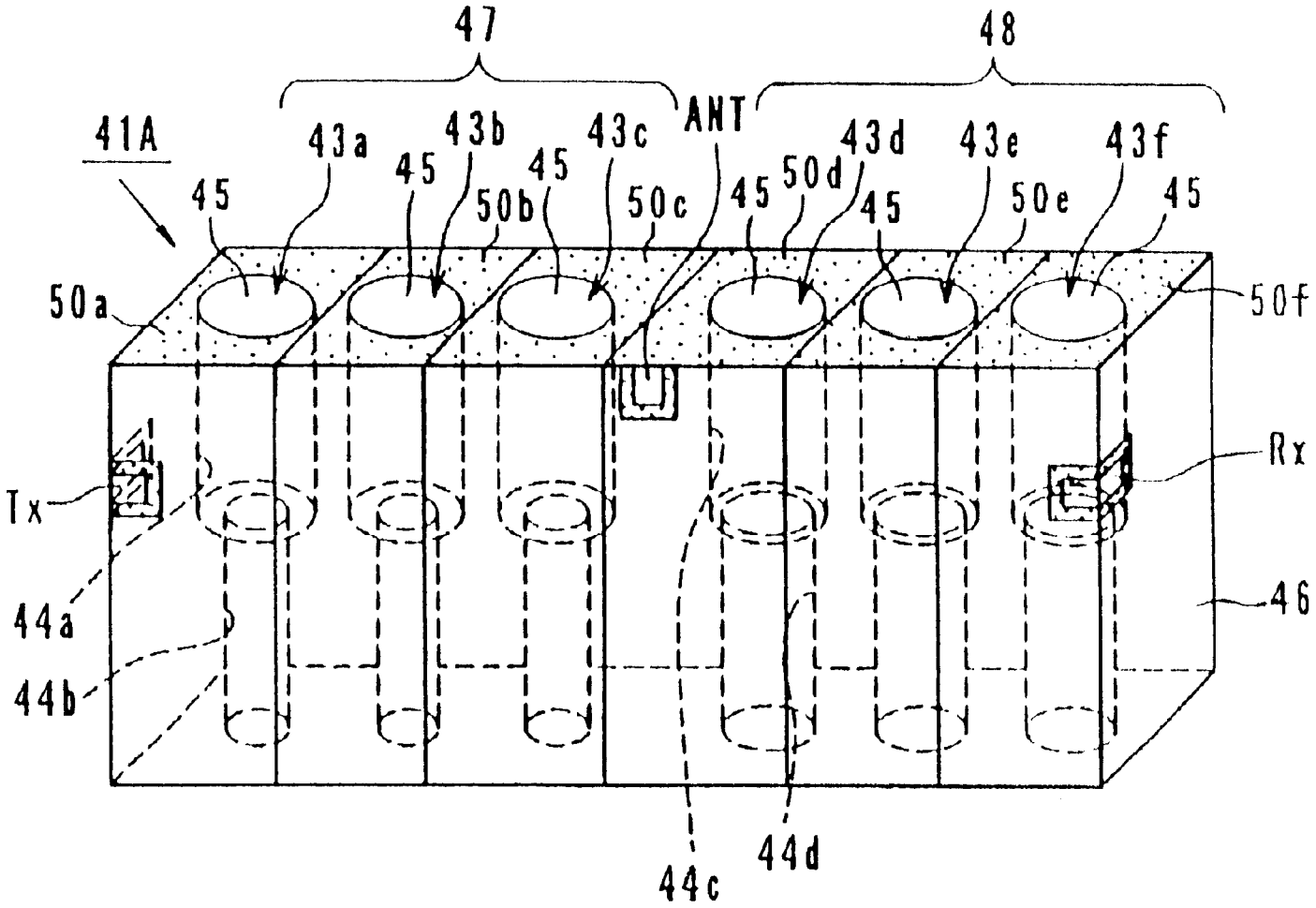
FIG. 3 is a perspective view showing a modification of the duplexer shown in FIG. 2.
Figure 4:
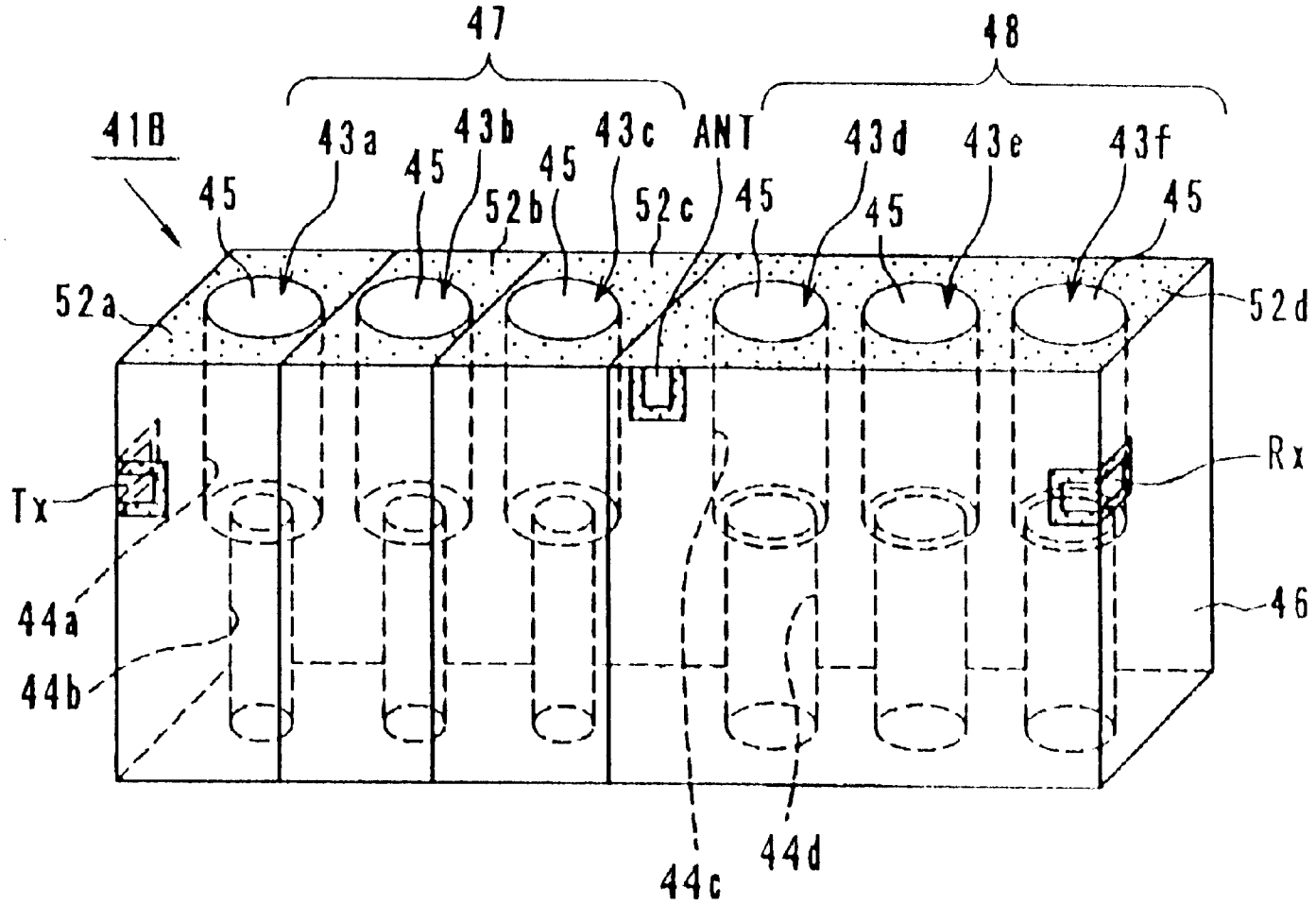
FIG. 4 is a perspective view showing another modification of the duplexer shown in FIG. 2.

Second Preferred Embodiment, FIGS. 2 through 4

Another preferred embodiment of a duplexer according to the present invention is shown in FIG. 2. The duplexer 41 is made up of a single dielectric block 42 in the form of a rectangular solid. The dielectric block 42 has resonator holes 43*a* through 43*f* passing from one of opposing end surfaces 42*a* and 42*b* of the dielectric block completely through to the other.

The resonator holes 43*a* through 43*c* constituting a transmission filter 47 are identical in shape to each other and are of a stepped hole having a large-sectional area portion 44*a* and a small-sectional area portion 44*b* connected to the large-sectional area portion 44*a*. The resonator holes 43*d* through 43*f* constituting a reception filter 48 are identical in shape to each other and are of a stepped hole having a large-sectional area portion 44*c* and a small-sectional area portion 44*d* linked to the large-sectional area portion 44*c*. On the inner surface of the resonator holes 43*a* through 43*f* an inner conductor 45 is disposed, respectively. And the step ratio of the resonator holes 43*a* through 43*c* of the transmission filter 47 and the step ratio of the resonator holes 43*d* through 43*f* of the transmission filter 48 are independently established.

On the outer surface of the dielectric block 42*a*, an outer conductor 46 is disposed on substantially all the surface except the end surface 42*a*, a transmission terminal Tx, a reception terminal Rx, and an antenna terminal ANT. The inner conductor 45 of each of the resonator holes 43*a* through 43*f* is electrically separated from the outer conductor 46 at the end surface 42*a* (that is, being open-ended), and is made being conducted to the outer conductor 46 at the end surface 42*b* (short-circuited).

The resonator hole 43*a* constitutes one dielectric resonator together with the inner conductor 45 disposed on the inner surface of the resonator hole, the dielectric block 42, and the outer conductor 46. In like manner, the resonator holes 43*b* through 43*f* constitute dielectric resonators, respectively. Therefore, the filters 47 and 48 become three-stage bandpass filters, respectively.

The duplexer 41 of the above construction shows the same effect as that of the duplexer 21 according to the first preferred embodiment.

And the duplexer 41 shown in FIG. 2 is made up of a single dielectric block 41, but the duplexer is not necessarily limited to this. The duplexer may be a duplexer 41A in which the dielectric blocks 50*a* through 50*f* divided into each of resonator holes 43*a* through 43*f* are joined and connected as shown in FIG. 3. The outer conductor 46 is disposed on the outer surface of the joined and connected dielectric blocks 50*a*through 50*f*. Or, as shown in FIG. 4, the duplexer may be a duplexer 41B in which the transmission filter 47 is composed of dielectric blocks 52*a* through 52*c* divided into each of resonator holes 43*a* through 43*c* and the reception filter 48 is composed of a single dielectric block 52*d*.

Figure 5:
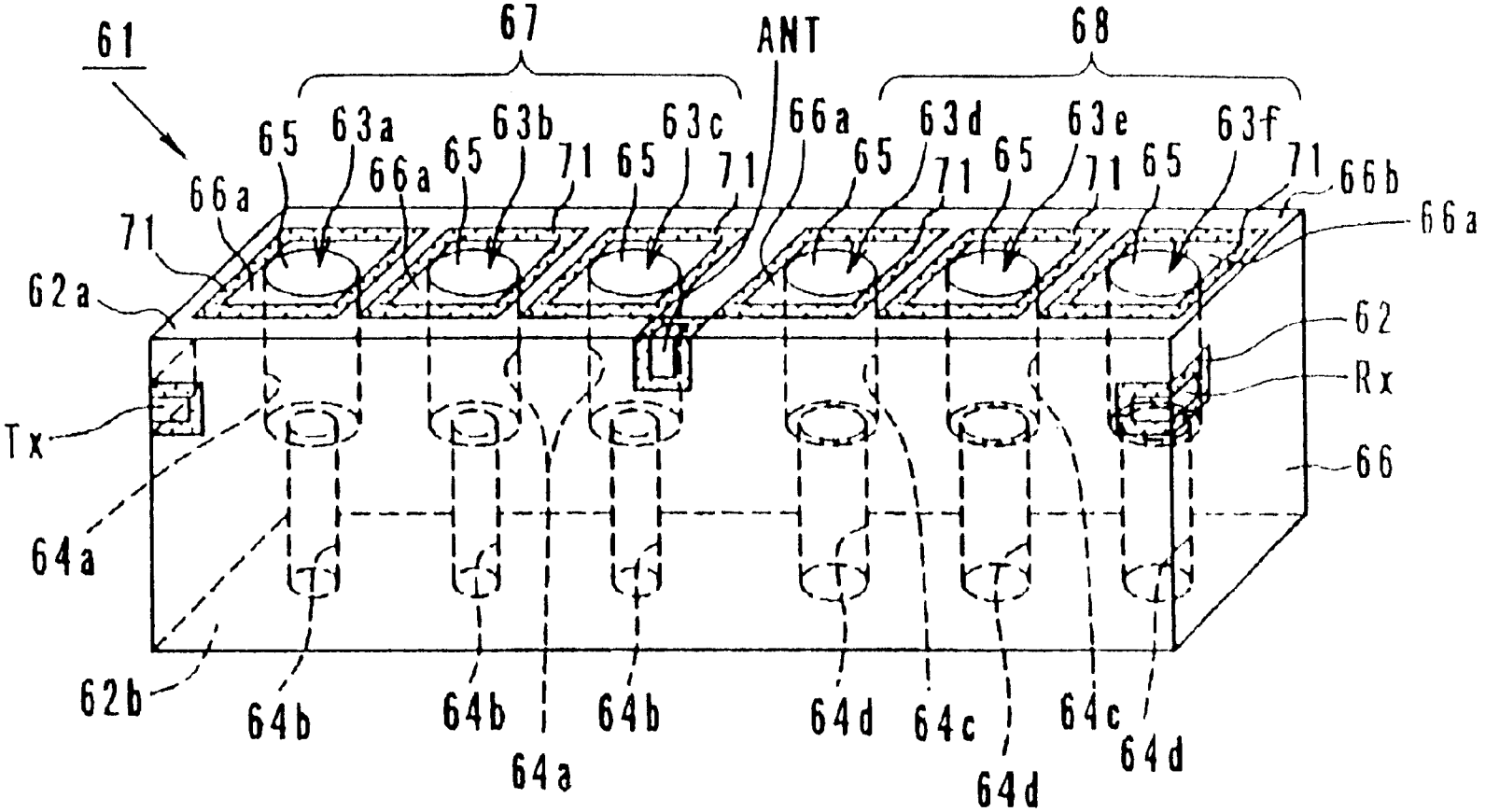
FIG. 5 is a perspective view showing a third preferred embodiment of a duplexer according to the present invention.

Third Preferred Embodiment, FIG. 5

Another embodiment of a duplexer according to the present invention is shown in FIG. 5. The duplexer 61 is made up of a single dielectric block 62 in the form of a rectangular solid. The dielectric block 62 contains resonator holes 63*a* through 63*f* passing from one of opposing end surfaces of the dielectric block completely through to the other.

The resonator holes 63*a* through 63*c* constituting a transmission filter 67 are identical in shape to each other and are of a stepped hole having a large-sectional area portion 64*a* and a small-sectional area portion 64*b* connected to the large-sectional area portion 64*a*. The resonator holes 63*d* through 63*f* constituting a reception filter 68 are identical in shape to each other and are of a stepped hole having a large-sectional area portion 64*c* and a small-sectional area portion 64*d* linked to the large-sectional area portion 64*c*. On the inner surface of the resonator holes 63*a* through 63*f* an inner conductor 65 is disposed, respectively. And the step ratio of the resonator holes 63*a* through 63*c* of the transmission filter 67 and the step ratio of the resonator holes 63*d* through 63*f* of the transmission filter 68 are independently established.

On the outer surface of the dielectric block 62, an outer conductor 66 is disposed on substantially all the surface except a transmission terminal Tx, a reception terminal Rx, and an antenna terminal ANT. As for the outer conductor 66, the conductor on the end surface 62*a* of the dielectric block 62 is electrically separated into an internal portion 66*a* including the resonator holes 63*a* through 63*f* inside and a surrounding portion 66*b* given around the internal portion 66*a* by a strip-like nonconductive portion 71 enclosing each of the resonator holes 63*a* through 63*f* in a square form. Accordingly, the inner conductor 65 of each of the resonator holes 63*a* through 63*f* is electrically separated (set free) from the outer conductor 66 on the end surface 62*a*, and is electrically connected (shortcircuited) to the outer conductor 66 on the end surface 62*b*.

The resonator hole 63*a* constitutes one dielectric resonator together with the inner conductor 65 formed on the inner surface of the resonator hole, the dielectric block 62, and the outer conductor 66. In like manner, the resonator holes 63*b* through 63*f* constitute dielectric resonators, respectively. Therefore, the filters 67 and 68 become three-stage bandpass filters, respectively.

The duplexer 61 having the above construction shows the same effect as that of the duplexer 21 according to the first embodiment.

Figure 6:
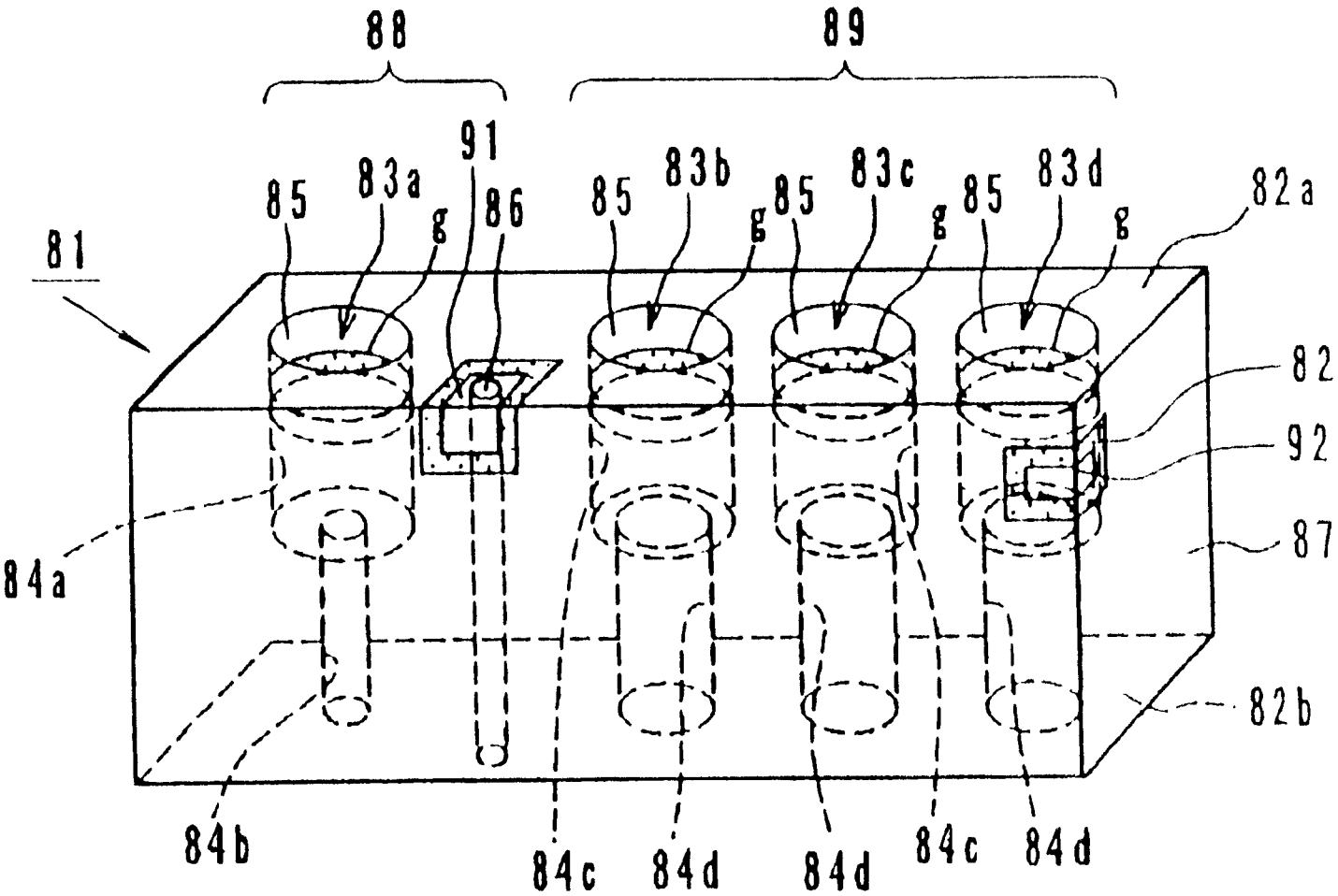
FIG. 6 is a perspective view showing one preferred embodiment of a dielectric filter unit according to the present invention.

Fourth Preferred Embodiment, FIG. 6

An embodiment of a dielectric filter unit according to the present invention is shown in FIG. 6. The dielectric filter unit 81 is made up of a single dielectric block 82 in the form of a rectangular solid. The dielectric block 82 contains resonator holes 83*a* through 83*d* passing from one of opposing end surfaces 82*a* and 82*b* completely through to the other. These resonator holes 83*a* through 83*d* are provided in the dielectric block 82 so that the axes of the resonator holes are in parallel to each other. Between the resonator holes 83*a* and 83*b* an external coupling hole 86 is formed.

The resonator holes 83*b* through 83*d* constituting a bandpass filter 89 are identical in shape to each other and provide a stepped hole having a large-sectional area portion 84*c* and a small-sectional area portion 84*d* connected to the large-sectional area portion 84*c*. The resonator holes 83*a* constituting a band-stop filter 88 provides a stepped hole having a large-sectional area portion 84*a* and a small-sectional area portion 84*b* linked to the large-sectional area portion 84*a*. On the inner surface of the resonator holes 83*a* through 83*d* an inner conductor 85 is disposed, respectively. And the step ratio of the resonator holes 83*b* through 83*d* of the bandpass filter 89 and the step ratio of the resonator hole 83*a* of the band-stop filter 88 are independently established.

On the outer surface of the dielectric block 82, an outer conductor 87 is disposed on substantially all the surface except input-output terminals 91 and 92. In the inner conductor 85 of the resonator holes 83*a* through 83*d*a nonconductive portion indicated by g is provided in the vicinity of the end portion on the side of the large-sectional area portions 84*a* and 84*c*, and this portion (that is, portion electrically separated from the outer conductor 87) is made open-ended. On the other hand, the portion of the inner conductor 85 (that is, portion electrically connected to the outer conductor 87) opposite to the electrically open end is made short-circuited.

The resonator hole 83*a* constitutes one dielectric resonator together with the inner conductor 85 formed on the inner surface of the resonator hole, the dielectric block 82, and the outer conductor 87. In like manner, the resonator holes 83*b* through 83*d* constitute dielectric resonators, respectively. Therefore, the filter 89 becomes a three-stage bandpass filter, and the filter 88 becomes a one-stage band-stop filter. On the whole inner surface of the external coupling hole 86 an inner conductor is disposed. And the external coupling hole 86 is conducted to the input-output terminal 91. That is, the inner conductor of the external coupling hole 86 is electrically separated from the external couductor 87 on the end surface 82*a* and is electrically conducted to the outer conductor 87 on the end surface 82*b*.

The input-output terminals 91 and 92 keeping a fixed spacing to the outer conductor 87 are disposed so as to be not conductive to the outer conductor 87. The coupling hole 86 connected to the input-output terminal 91 and the resonator holes 83*a* and 83*b* neighboring the input-output terminal are electromagnetically coupled, and through this electromagnetic coupling the external coupling is realized. Between the input-output terminal 92 and the resonator hole 83*d* an external coupling capacitance Ce is generated.

In the above structure and arrangement, for example, when the center frequency of the band-stop filter 88 is lower than the center frequency of the bandpass filter 89, the step ratio of the resonator hole 83*a* is made larger than the step ratio of the resonator holes 83*b* through 83*d* by increasing the step ratio of the resonator hole 83*a* of the band-stop filter 88 or by reducing the step ratio of the resonator holes 83*b* through 83*d* of the bandpass filter 89. For example, if the step ratio of the resonator hole 83*a* is increased, the step portion provided between the large-sectional area portion 84*a* and the small-sectional area portion 84*b* is heightened. Accordingly, because the conductor path of the inner conductor 85 runs along the surface of the step portion and is lengthened that much, the center frequency of the band-stop filter 88 is increased even if the length of the dielectric block 82 of the band-stop filter 88 in the axial direction of the rsonator hole 83*a* is not lengthened.

In the dielectric filter 81 shown in FIG. 6, the large-sectional area portion 84*a* of the resonator hole 83*a* and the large-sectional area portion 84*c* of the resonator holes 83*b* through 83*d* are set to be equal in diameter, and the small-sectional area portion 84*b* of the resonator hole 83*a* is set to be smaller in diameter than the small-sectional area portion 84*d* of the resonator holes 83*b* through 83*d*. Because of this, the location of the nonconductive portion g of the inner conductor 85 can be made uniform regarding all of the resonator holes 83*a* through 83*de*. And the length of the dielectric block 82 (that is, resonator length) in the axial direction of the resonator holes 83*a* through 83*d*, of each of the filters 88 and 89 can be made equal. As the result, the dielectric filter unit 81 which is easy to process and assemble can be obtained.

Figure 7:
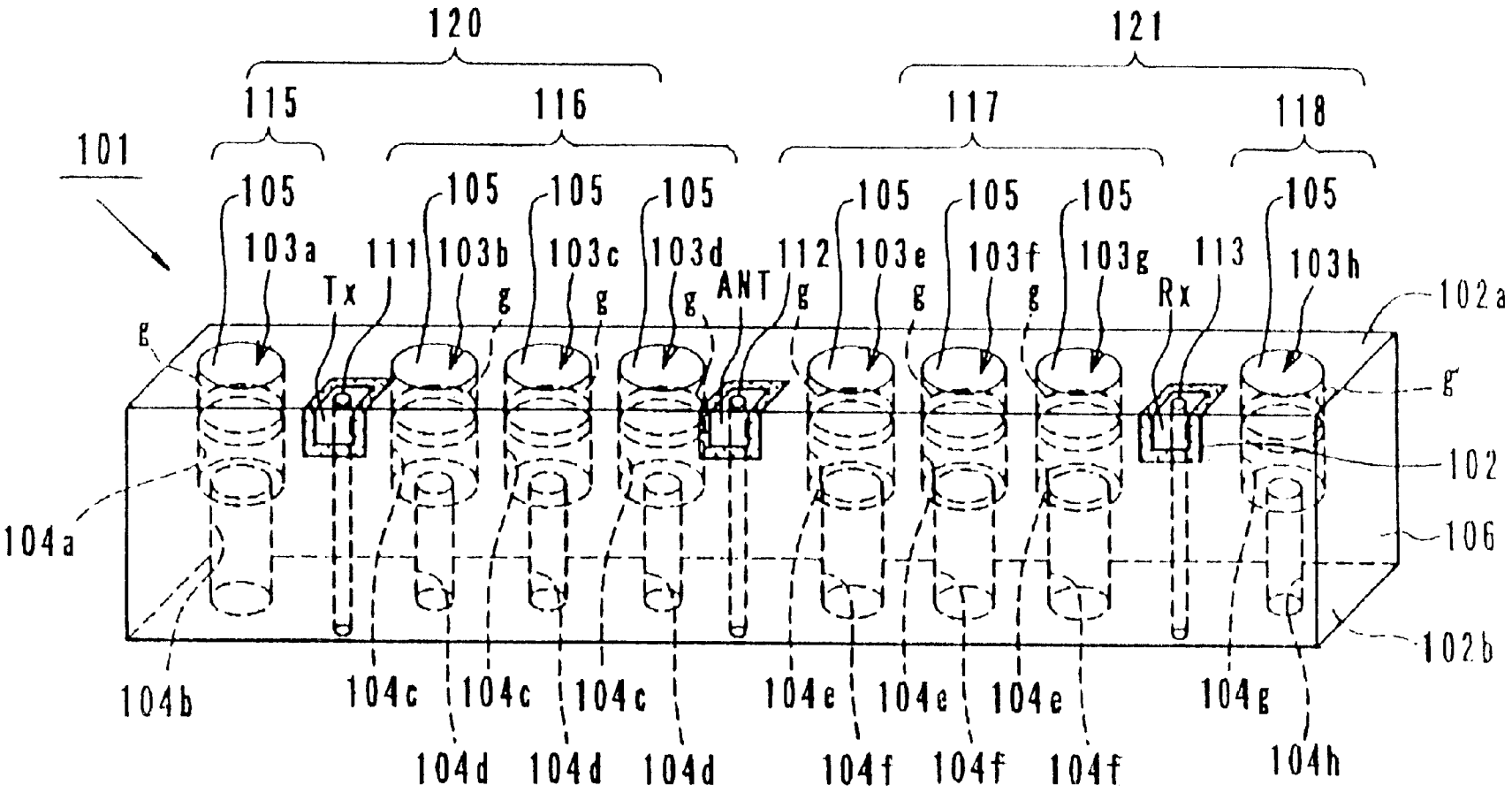
FIG. 7 is a perspective view showing a fourth preferred embodiment of a duplexer according to the present invention.

Fifth Preferred Embodiment, FIG. 7

Another preferred embodiment of a duplexer according to the present invention is shown in FIG. 7. The duplexer 101 contains four filters and is made up of a single dielectric block 102 in the form of a rectangular solid. The dielectric block 102 contains resonator holes 103*a* through 103*h* passing from one of opposing end surfaces 102*a* and 102*b* completely through to the other. Between the resonator holes 103*a* and 103*b*, between the resonator holes 103*d* and 103*e*, and between the resonator holes 103*g* and 103*h* external coupling holes 111, 112, and 113 are formed.

A transmission filter 120 is made up of a band stop filter 115 and a bandpass filter 116. The resonator holes 103*b* through 103*d* constituting the bandpass filter 116 are identical in shape to each other and are of a stepped hole having a large-sectional area portion 104*c* and a small-sectional area portion 104*d* linked to the large-sectional area portion 104*c*. The resonator hole 103*a* constituting the band-stop filter 115 is of a stepped hole having a large sectional area portion 104*a* and a small-sectional area portion 104*b* linked to the large-sectional area portion 104*a*. On the inner surface of the resonator holes 103*a* through 103*d* an inner conductor 105 is formed, respectively. And the step ratio of the resonator holes 103*b* through 103*d* of the bandpass filter 116 and the step ratio of the resonator hole 103*a* of the band-stop filter 11 are separately set.

A reception filter 121 is made up of a band-stop filter 118 and a bandpass filter 117. The resonator holes 103*e* through 103*g* constituting the bandpass filter 117 are identical in shape to each other and are of a stepped hole having a large-sectional area portion 104*e* and a small-sectional area portion 104*f* linked to the large-sectional area portion 104*e*. The resonator hole 103*h* constituting the band-stop filter 118 is of a stepped hole having a large-sectional area portion 104*g* and a small-sectional area portion 104*h* linked to the large-sectional area portion 104*g*. On the inner surface of the resonator holes 103*e* through 103*h* an inner conductor 105 is formed, respectively. And the step ratio of the resonator holes 103*e* through 103*g* of the bandpass filter 117 and the step ratio of the resonator hole 103*h* of the band-stop filter 118 are separately set.

On the outer surface of the dielectric block 102, an outer conductor 106 is disposed on subtantially all the surface except a transmission terminal Tx, a reception terminal Rx, and an antenna terminal ANT. The inner conductor 105 of each of the resonators 103*a* through 103*h* is electrically separated (open-ended) from the outer conductor 106 on the end surface 102*a*, and is electrically conducted (short-circuited) to the outer conductor 106 on the end surface 102*b*.

The resonator hole 103*a* constitutes one dielectric resonator together with the inner conductor 105 disposed on the inner surface of the resonator hole, the dielectric block 102, and the outer conductor 106. In like manner, the resonator holes 103*b* through 103*h* constitute dielectric resonators, respectively. Accordingly, the filters 116 and 117 become three-stage bandpass filters, respectively, and the filters 115 and 118 become one-stage band-stop filters, respectively. On all the inner surface of the external coupling holes 111, 112, and 113 an inner conductor is disposed, respectively. The external coupling holes 111, 112, and 113 are conducted to the transmission terminal Tx, reception terminal Rx, and antenna terminal ANT, respectively. That is, the inner conductor of each of the external coupling holes 111 through 113 is electrically separated from the outer conductor 106 on the end surface 102*a* and is electrically conducted to the outer conductor 106 on the end surface 102*b*.

The duplexer 101 of the above construction shows the same effect as that of the duplexer 21 according to the first preferred embodiment.

Figure 8:
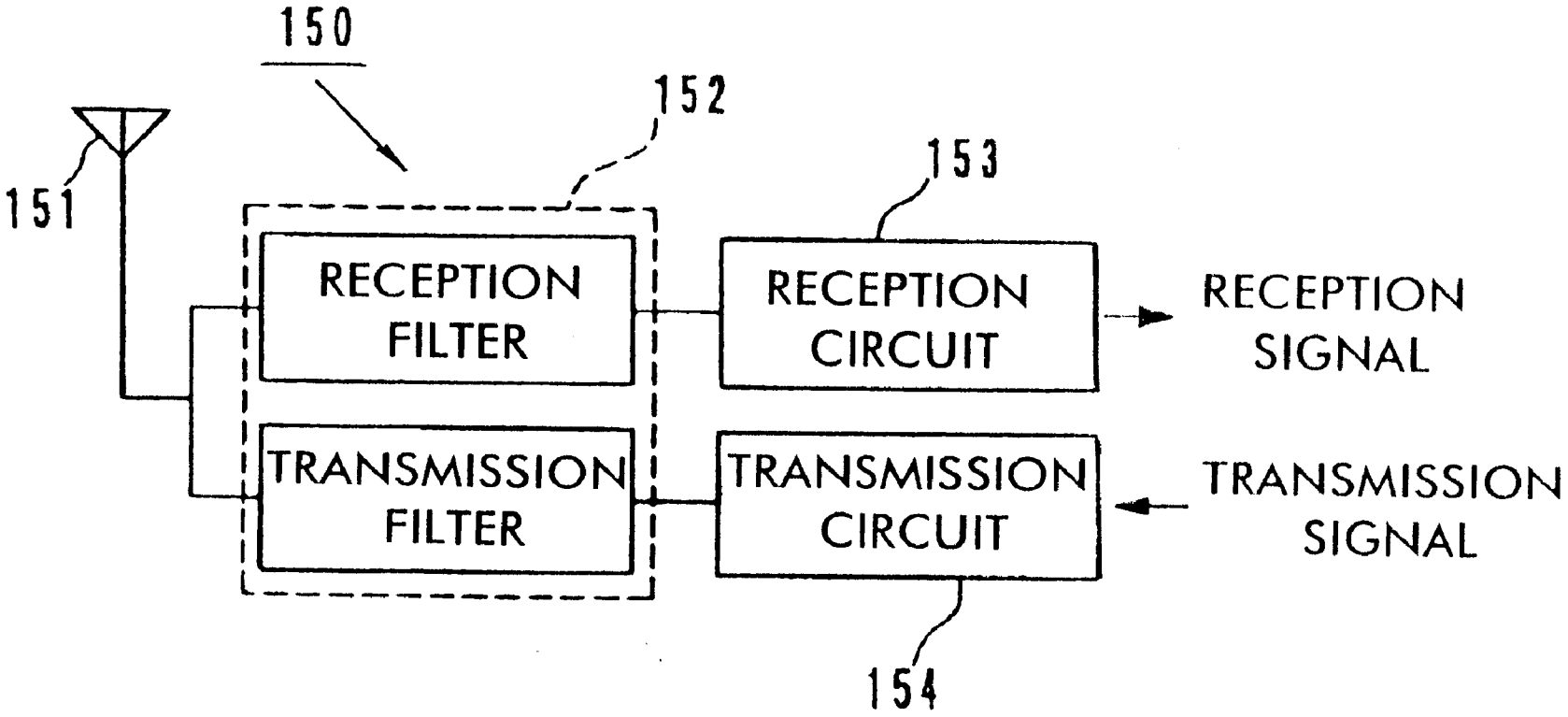
FIG. 8 is the electric circuit block diagram showing one preferred embodiment of a communication apparatus according to the present invention.
Figure 9:
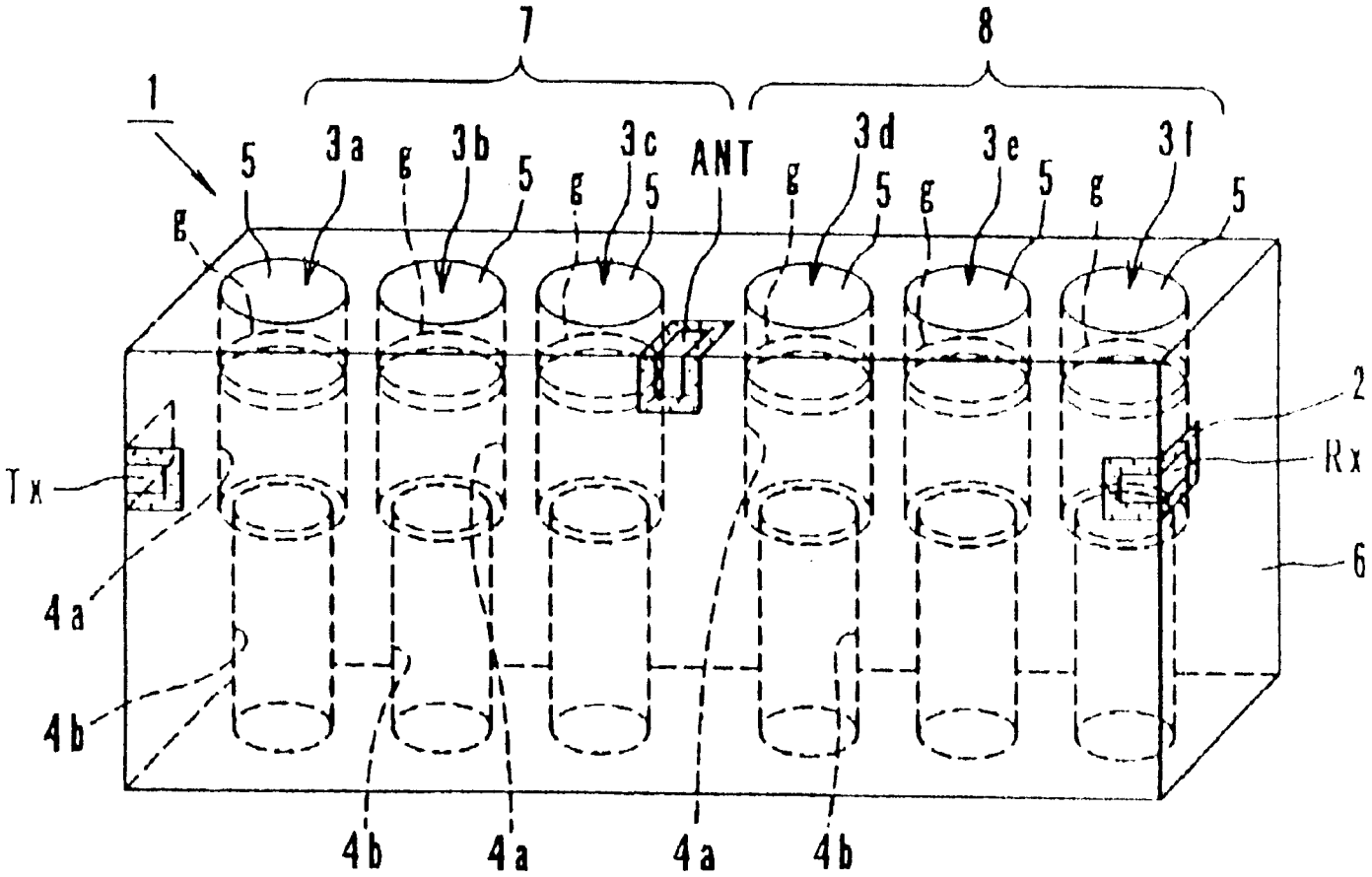
FIG. 9 PRIOR ART
FIG. 9 a perspective view showing a prior art duplexer.

Sixth Preferred Embodiment, FIG. 8

A sixth preferred embodiment shows a communication apparatus according to the present invention, and as an example a portable telephone is explained. FIG. 8 is an electric circuit block diagram of the transmissionreception RF portion of a portable telephone. In FIG. 8, reference numeral 151 represents an antenna element, 152 a unit for shared antenna, 153 a reception circuit, and 154 a transmission circuit. Here, as a unit for shared antenna 152, the duplexers 21, 41, 61, and 101 of the first, second, third, and fifth preferred embodiment can be used.

Other Preferred Embodiments

More, a dielectric filter unit, duplexer, and communication apparatus according to the present invention are not limited to the above embodiments, and within the scope of the invention various modifications are possible. Particularly, in the above embodiments, as the length in axial direction of the large-sectional area portion and the length in axial direction of the small-sectional area portion of the resonator holes are equal, the step portion formed at the boundary is located in the middle portion in axial direction of the resonator holes, but this is not necessarily limited to. By making different the length in axial direction of the large-sectional area portion and the length in axial direction of the small-sectional area portion, the step portion may be able to be formed in the vicinity of the opening portion of the resonator holes.

Further, in the above amendments, each of the large-sectional area portions and the small-sectional area portions of the resonator holes is circular shape. However, the shape is not limited to circle. It is apparent that a triangle shape, a square shape, a polygon shape, and so on are also applicable as the shape of the large-sectional area portions and the small-sectional area portions of the resonator holes.

In the above described dielectric filter unit, at least one of the large-sectional area portions or at least one of the small-sectional area portions of the resonator holes may be a circular shape, a rectangular shape, and so on.

In the above described dielectric filter unit, the inner conductor may have a nonconductive portion in the vicinity of one open end portion of the resonator hole.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter unit comprising:

a dielectric block having a pair of opposing end surfaces;

a plurality of resonator holes respectively passing through the pair of opposing end surfaces of the dielectric block and having a large-sectional area portion, and a small-sectional area portion connected to the large-sectional area portion;

an inner conductor disposed on the inner surface of each of the resonator holes;

an outer conductor disposed on the outer surface of the dielectric block;

at least one of the resonator holes constituting a first filter;

at least one of the remaining resonator holes constituting a second filter; and the area ratio of the large-sectional area portion to the small-sectional area portion of the resonator hole of the first filter being different from the area ratio of the large-sectional area portion to the small-sectional area portion of the resonator hole of the second filter, wherein the inner conductor has a nonconductive portion in the vicinity of one open end portion of the resonator hole.

2. A dielectric filter unit comprising:

a dielectric block having a pair of opposing end surfaces;

a plurality of resonator holes respectively passing through the pair of opposing end surfaces of the dielectric block and having a large-sectional area portion, and a small-sectional area portion connected to the large-sectional area portion;

an inner conductor disposed on the inner surface of each of the resonator holes;

an outer conductor disposed on the outer surface of the dielectric block;

at least one of the resonator holes constituting a first filter;

at least one of the remaining resonator holes constituting a second filter; and the area ratio of the large-sectional area portion to the small-sectional area portion of the resonator hole of the first filter being different from the area ratio of the large-sectional area portion to the small-sectional area portion of the resonator hole of the second filter, wherein the outer conductor is extended to the pair of end surfaces of the dielectric block where the resonator holes pass through;

the outer conductor disposed on one of the pair of end surfaces is electrically separated into an internal portion and a surrounding portion by a strip-like nonconductive portion surrounding each resonator hole;

the internal portion includes each resonator hole; and the surrounding portion surrounds the internal portion.

3. A dielectric filter unit comprising:

a dielectric block having a pair of opposing end surfaces;

a plurality of resonator holes respectively passing through the pair of opposing end surfaces of the dielectric block and having a large-sectional area portion, and a small-sectional area portion connected to the large-sectional area portion;

an inner conductor disposed on the inner surface of each of the resonator holes;

an outer conductor disposed on the outer surface of the dielectric block;

at least one of the resonator holes constituting a first filter;

at least one of the remaining resonator holes constituting a second filter; and the area ratio of the large-sectional area portion to the small-sectional area portion of the resonator hole of the first filter being different from the area ratio of the large-sectional area portion to the small-sectional area portion of the resonator hole of the second filter, wherein the dielectric block is divided corresponding to the respective resonator holes.

4. The dielectric filter unit according to claim 1, wherein the dielectric block is divided corresponding to the respective resonator holes.

5. The dielectric filter unit according to claim 2, wherein the dielectric block is divided corresponding to the respective resonator holes.

6. A dielectric filter unit comprising:

a dielectric block having a pair of opposing end surfaces;

a plurality of resonator holes respectively passing through the pair of opposing end surfaces of the dielectric block and having a large-sectional area portion, and a small-sectional area portion connected to the large-sectional area portion;

an inner conductor disposed on the inner surface of each of the resonator holes;

an outer conductor disposed on the outer surface of the dielectric block;

at least one of the resonator holes constituting a first filter;

at least one of the remaining resonator holes constituting a second filter; and the area ratio of the large-sectional area portion to the small-sectional area portion of the resonator hole of the first filter being different from the area ratio of the large-sectional area portion to the small-sectional area portion of the resonator hole of the second filter; wherein the first filter comprises a dielectric block which is divided corresponding to the respective resonator holes; and the second filter comprises a single dielectric block.

7. The dielectric filter unit according to claim 1, wherein the first filter comprises a dielectric block which is divided corresponding to the respective resonator holes; and the second filter comprises a single dielectric block.

8. The dielectric filter unit according to claim 2, wherein the first filter comprises a dielectric block which is divided corresponding to the respective resonator holes; and the second filter comprises a single dielectric block.

9. A duplexer comprising the dielectric filter unit according to any one of claims 1 to 8.

10. A communication apparatus comprising the dielectric filter according to any one of claims 1 to 8.

11. A communication apparatus comprising the duplexer of claim 9.

12. The dielectric filter unit according to any one of claims 1 to 8, wherein at least one of the large-sectional area portions or at least one of the small-sectional area portions of the resonator holes has a circular shape.

13. The dielectric filter unit according to any one of claims 1 to 8, wherein at least one of the large-sectional area portions or at least one of the small-sectional area portions of the resonator holes has a triangular shape.

14. The dielectric filter unit according to any one of claims 1 to 8, wherein at least one of the large-sectional area portions or at least one of the small-sectional area portions of the resonator holes has a square shape.

15. The dielectric filter unit according to any one of claims 1 to 8, wherein at least one of the large-sectional area portions or at least one of the small-sectional area portions of the resonator holes has a polygonal shape.

* * * * *